US005605307A

United States Patent [19]

Batchman et al.

[11] Patent Number: 5,605,307

[45] Date of Patent: Feb. 25, 1997

[54] MISSILE SYSTEM INCORPORATING A TARGETING AID FOR MAN-IN-THE-LOOP MISSILE CONTROLLER

[75] Inventors: Loren E. Batchman, Solana Beach, Calif.; Carl G. Foster, Tucson, Ariz.

[73] Assignee: Hughes Aircraft Compay, Los Angeles, Calif.

[21] Appl. No.: 487,367

[22] Filed: Jun. 7, 1995

[51] Int. Cl.[6] ..... F42B 15/00

[52] U.S. Cl. ..... 244/3.11; 244/3.12; 244/3.13; 244/3.14

[58] Field of Search ..... 244/3.11, 3.12, 244/3.13, 3.14; 114/20.1, 20.2; 342/67; 89/41.05

[56] References Cited

U.S. PATENT DOCUMENTS

| | | | |
|---|---|---|---|
| 3,567,163 | 3/1971 | Kepp et al. | 244/3.14 |
| 4,267,562 | 5/1981 | Raimondi | 89/41.05 |
| 4,274,609 | 6/1981 | Ferrier et al. | 244/3.14 |
| 4,611,771 | 9/1986 | Gibbons et al. | 244/3.11 |
| 4,907,763 | 3/1990 | Pinson | 244/3.12 |
| 5,042,743 | 8/1991 | Carney | 244/3.11 |
| 5,379,676 | 1/1995 | Profeta et al. | 89/41.05 |

*Primary Examiner*—Michael J. Carone
*Assistant Examiner*—Theresa M. Wesson
*Attorney, Agent, or Firm*—Charles D. Brown; Wanda K. Denson-Low

[57] ABSTRACT

A missile is remotely controlled by a person operating with a base controller that displays an image of an aim-point target. Simultaneously, the base controller displays, as an overlay, a prosecutable target locus that represents the outer boundary of the region that may be hit by the missile, in the event that a maximum change in the guidance commands were to be introduced at that moment. The prosecutable target locus depends upon missile performance capability and the location of the missile relative to the aim-point target, which are provided to the base controller.

15 Claims, 4 Drawing Sheets

MISSILE SYSTEM INCORPORATING A TARGETING AID FOR MAN-IN-THE-LOOP MISSILE CONTROLLER

BACKGROUND OF THE INVENTION

This invention relates to remotely controlled vehicle systems, and, more particularly, to remotely controlled missiles in which some portion of the guidance is aided by a human being.

In one type of precision weaponry, a missile is remotely guided on its flight toward its target by, or accepts updates to a preplanned target from, a person (the operator) at a base location. The operator typically observes the image of the target and the aim point of the missile on a video or radar display, and monitors a cross-hair or other aim-point symbol relative to the target. The operator may instead designate alterative aim points within the field of view. A computer in the missile guidance system makes adjustments to the control surfaces, engine thrust (if there is an engine and it is adjustable), or other controllable aspects of the missile through a remote-control data link to the missile in order to guide it to the physical location designated by the cross-hair. The aiming function and target prosecution can be accomplished automatically in some cases. However, experience has shown that for many missions, corrections to the aim point or target lock features transmitted by the "man-in-the-loop" system just described produces results superior to those of a fully automated system.

The missile system using the man-in-the-loop control system has limitations. The operator must have a considerable amount of experience in remotely "flying" the missile, gained through simulators or live exercises, and must be adept at interpreting the video imagery and evaluating the missile capability of prosecuting the correct target in real time, in order to be an effective part of the control system. It may sometimes be necessary to use a less-experienced person. In other situations, however, even the best training and a great deal of experience may be insufficient to enable the operator to solve the problems presented. For example, an unexpected change in plans, weather conditions, or change in the target appearance on video may raise a question as to whether it remains feasible for the missile to reach a preplanned primary target. A decision as to possible alternatives and the viability of those alternatives must be made so quickly that the training cannot be effectively applied.

There is a need for an improved remotely controllable missile system using the "man-in-the-loop" approach, which is more effectively operated by less-experienced persons and allows an effective response to unexpected situations. The present invention fulfills this need, and further provides related advantages.

SUMMARY OF THE INVENTION

The present invention provides an improved "man-in-the-loop" remotely controlled vehicle system wherein the control system aids the operator in making assessments of available alternatives in both conventional and unconventional situations. The distraction to the operator of features and events outside the possible range of targets is reduced. There is a reduced likelihood of unwanted collateral damage resulting from an attempt to prosecute an unachievable target. The possibility of wasting a missile due to an attempt to reach an unprosecutable target is reduced. The system achieves improved controllability with little added per-missile costs.

In accordance with the invention, a remotely controlled vehicle system, comprises a remote vehicle, a source of remote vehicle performance capability data, a source of remote vehicle location data, a source of remote vehicle imagery, and a base controller including a guidance controller by which a person selectively produces guidance commands for the remote vehicle. A data link between the base controller and the remote vehicle includes a guidance data channel carrying the guidance commands from the base controller to the remote vehicle. The vehicle system further includes means for providing to the operator a representation of a prosecutable target locus of the remote vehicle within the remote vehicle imagery responsive to the performance capability data and the vehicle location data.

The invention is broadly applicable to a range of types of vehicle systems, but is preferably implemented in relation to a missile. As used herein, a "missile" includes both powered and unpowered vehicles used against targets, and includes vehicles that operate in the air, in space, or underwater. In accordance with this aspect of the invention, a remotely controlled vehicle system comprises a missile, a source of missile performance capability data, and a source of missile location data. A base controller includes a guidance controller by which a person selectively produces guidance commands for the missile. The guidance controller includes a video display that produces an image viewable by the operator of an aim-point target, and a control unit operable by the operator to generate guidance commands responsive to the image on the video display. A data link between the base controller and the missile includes a guidance data channel carrying the guidance commands from the base controller to the missile. A computer is configured to calculate a prosecutable locus result of a maximum change in a guidance command on the directional performance of the missile responsive to the missile performance capability data, the missile location data, and the aim-point target location, and to provide the prosecutable locus result to the video display.

The base controller presents to the operator in the control loop the range of feasible alternatives at any moment. This information is preferably presented not in an abstract sense, but in terms of the ultimate mission of reaching the target. The presentation is graphic and fully integrated with the targeting information which the operator monitors, making its use straightforward and natural.

Within this framework, many alternative approaches can be employed. For example, the remote vehicle capability data can come in part from data stored at the base controller and in part from the vehicle itself through the data link. The data link can be of any operable type, such as an electrical signal, an electromagnetic signal, light transmitted through an optical fiber, or even a satellite relay link if the time delay can be tolerated. The source of vehicle location data can be of any operable type. Examples include a source on board the vehicle itself such as a global positioning receiver, a laser sensor, a radio receiver, or an active radar, or a source apart from the remote vehicle such as a radar transceiver that scans the vehicle.

Of particular interest is the approach for presenting the prosecutable target locus to the operator in relation to the aim-point target. A preferred approach is to present on a video display an image viewed by a sensor in the missile, such as a television camera mounted in the nose of the missile, to the operator at the guidance controller. The operator places a cross hair of the guidance controller on the selected aim-point target. The guidance apparatus of the missile then operates the controllable features of the missile to guide it to the target in the cross hair. The field of prosecutable targets—that is, the field of targets that can be reached by the missile at that time as a result of changing the controllable features of the missile—is displayed on the same video display superimposed on the sensor image and the cross hair. The display is typically a line boundary around the prosecutable target locus. The operator thus reads from the graphic display whether it is an available option to reach some other target than the one at which the cross hairs are presently aimed.

The present invention thus provides a man-in-the-loop, remotely controlled vehicle system wherein the operator is assisted in the control procedure by information as to the range of prosecutable targets at any moment, provided in a readily used form. Other features and advantages of the present invention will be apparent from the following more detailed description of the preferred embodiment, taken in conjunction with the accompanying drawings, which illustrate, by way of example, the principles of the invention.

DETAILED DESCRIPTION OF THE INVENTION

Figure 1:
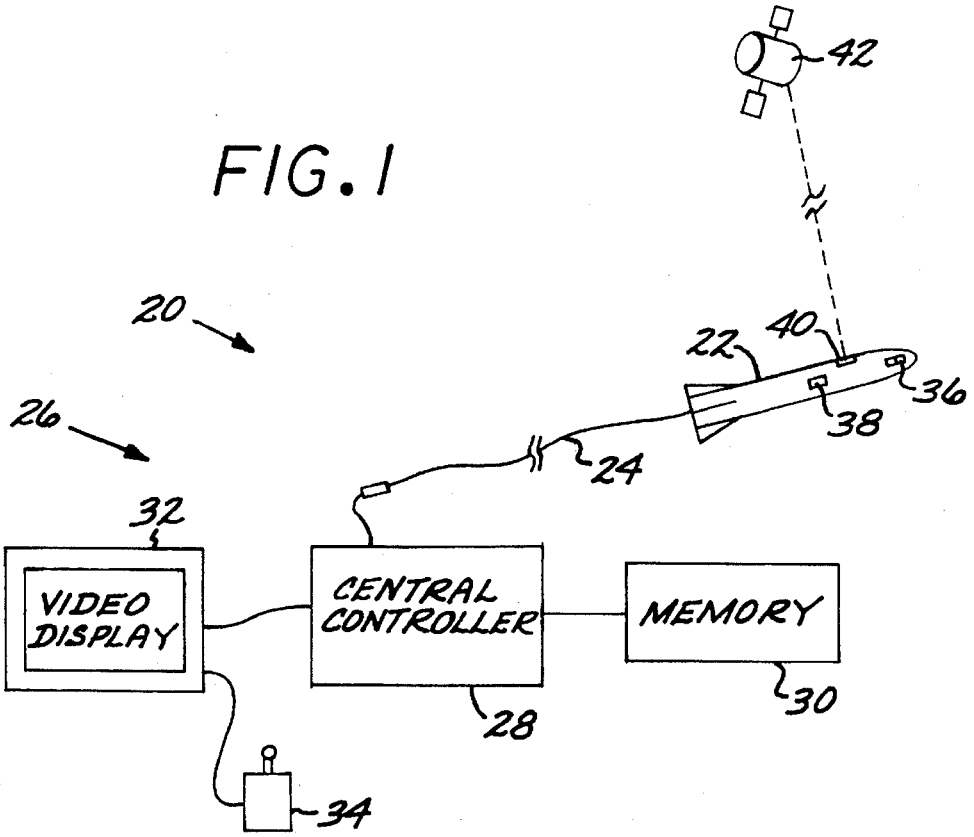
FIG. 1 is a schematic diagram of a first embodiment of a missile system.
Figure 2:
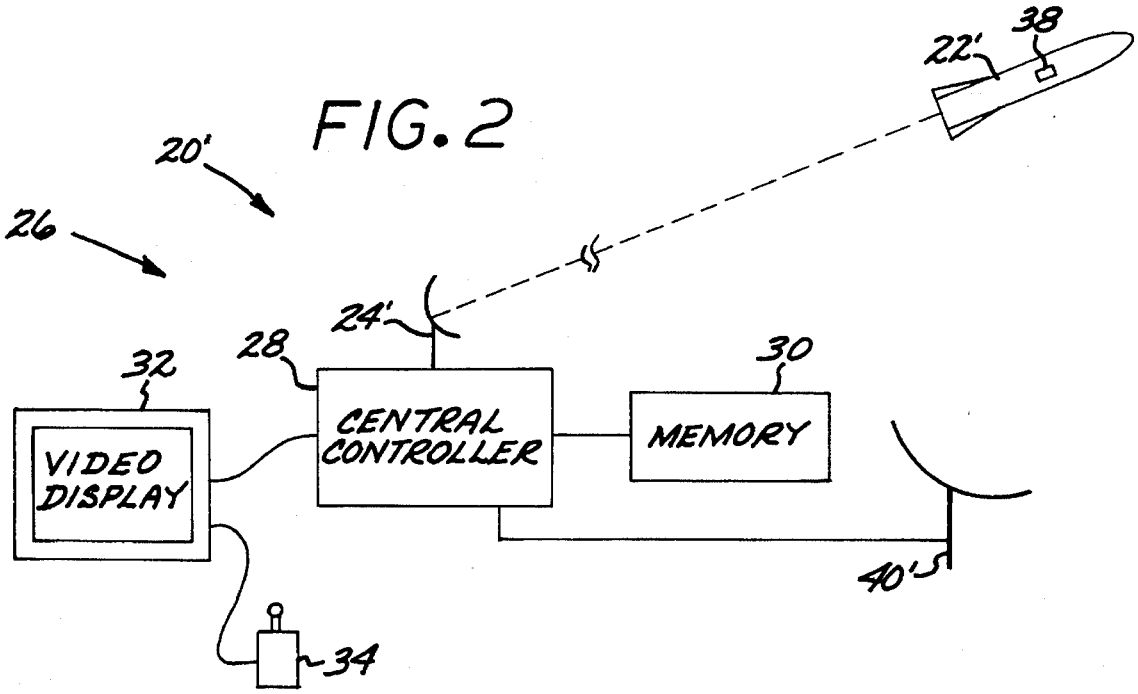
FIG. 2 is a schematic diagram of a second embodiment of a missile system.

FIGS. 1 and 2 illustrate two embodiments of a missile system in accordance with the invention. A missile system 20 of FIG. 1 includes a remote vehicle, here shown as a missile 22. A data link 24 in the form of an optical fiber or a metallic wire extends from the missile 22 to a base controller 26. The base controller 26 includes a central controller 28 having a memory 30 and a video display 32. (The missile 22 also usually has a computer and memory on board, as well.) A target indicator 34 utilizes a joy stick controller or a mouse to designate an aim-point target on the video display 32. Using the designated aim-point target from the video display 32, the central controller 28 generates guidance commands and transmits those guidance commands over a guidance channel of the data link 24 to the missile 22. Equivalently for the present purposes, the central controller 28 may be located in the missile 22, so that only corrections to the guidance commands generated by the target indicator 34 are transmitted over the data link 24 to the missile 22.

In the embodiment of FIG. 1, the missile 22 has a sensor such as a television camera 36 in its nose. Other types of sensors, such as infrared or radar sensors, are also operable. The sensor can also include a ranging device such as a laser that can accurately determine the distance of the missile to a target. Signals from the television camera 36 are transmitted over a video channel of the data link 24 to the central controller 28 and thence to the video display 32. The missile 22 may, and typically does, include on-board missile performance sensors 38 such as, for example, fuel status, attitude, acceleration, and engine performance sensors. Signals from the missile performance sensors 8 or, equivalently, an on-board controller, are carried over a sensor channel of the data link 24 to the central controller 28. The missile 22 additionally has an on-board location sensor 40, in this case a global positioning system (GPS) receiver that determines the position of the missile 22 relative to a constellation of orbiting satellites 42. Position signals from the location sensor 40 are transmitted over a location signal channel of the data link 24 to the central controller 28.

The embodiment of FIG. 2 depicts a similar missile system 20' in which some elements are varied, and accordingly are indicated with the corresponding elements from the embodiment of FIG. 1 except that a prime (') has been added to the numerical identifier. Other elements are substantially the same as in the missile system 20, and these elements have been assigned the same numbers as the corresponding elements of FIG. 1. The description of FIG. 1 is incorporated here. One principal variation in FIG. 2 is that the data link 24' is an electromagnetic signal between the base controller 26 and the missile 22'. A second variation is that the missile 22' has no television camera 36 and location sensor 40. Instead, the location of the missile 22' is determined by a location sensor 40' located separate from the missile 22'. In this case, the location sensor 40' is a remote radar transceiver. These and other variations of individual elements of the missile system 20 can be made within the overall system architecture. In the following discussion, the unprimed designations are utilized to encompass any operable element.

When the missile system 20 is operated, a human operator views the video display 32. The operator sees a cross-hair image (or other indicator) on the video display overlying an aim-point target image on the screen. The central controller 28 generates command signals based upon this targeting and transmits those signals to the missile 22 via the data link 24. With the present invention, the video display 32 also presents to the operator an indication of the prosecutable target locus. The "prosecutable target locus" is an indication of those features and the area displayed on the screen image which could possibly serve as targets in the sense that the missile could, if so directed, reach those targets. This information is useful to the operator because the operator is advised by the prosecutable target locus as to which areas could not be reached by the missile in the event of a change in targeting plans for any reason.

Figure 3:
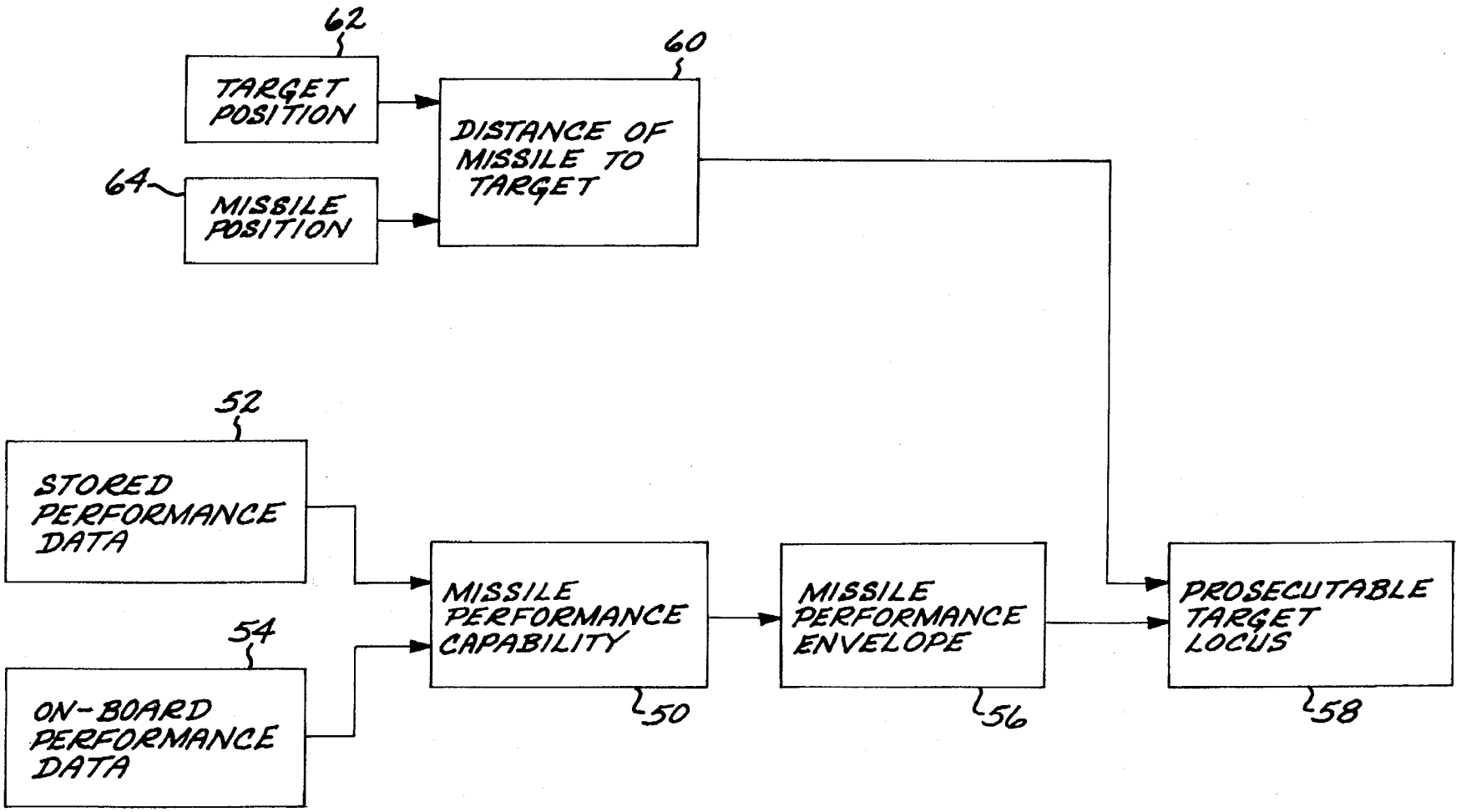
FIG. 3 is a block diagram of the elements used in determining and presenting the prosecutable target locus.
Figure 4:
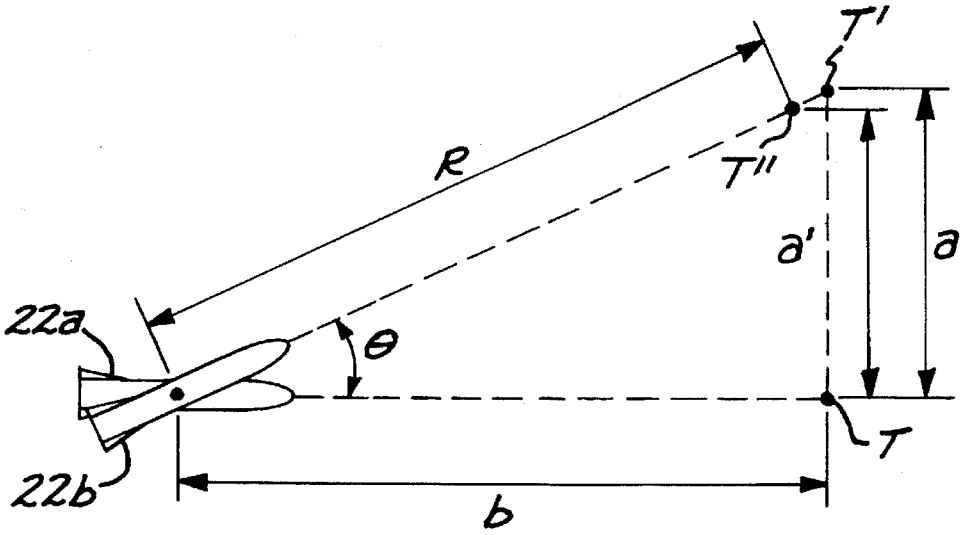
FIG. 4 is a diagram of a simplified relation between the maximum change in a missile control parameter and the prosecutable locus.

FIG. 3 presents the interrelationships of various elements of the missile system 20 in establishing the prosecutable target locus. The prosecutable target locus is largely determined by two factors, the performance capabilities of the missile and the distance of the missile to the target. FIG. 4 depicts these factors in an oversimplified form that is useful in understanding these considerations. A missile **22*a* is directed at an aim-point target T located a distance b from the missile. At a moment in time, if the missile were instantaneously pivoted through an angle θ to the orientation 22*b*, it would then be directed at a second aim-point target T', which is at a distance b tan θ from the initial aim-point target T. The greater the turning performance capability of the missile, expressed as θ, and the greater the distance the missile is from its initial aim-point target T, expressed as b, the greater can be the distance of the second aim-point target T' from the initial aim-point target T. However, if the available fuel of the missile 22***b* gives it a range R, which was sufficient to reach the target T but not the target T', then the ability to prosecute the target T' is prevented by the available fuel performance capability of the missile. Then the target prosecution locus at angle θ would be limited by the missile range to a target at T".

In practice, the missile cannot pivot instantaneously and would continue to maintain the turn for a period of time, so that the simple linear relations of FIG. 4 are not strictly valid. Nevertheless, the point remains that the greater the turning capability and the greater the distance of the missile from the target, the larger the area of potential prosecutable targets.

Several factors can affect the ability to prosecute targets over an area. One is the available range R. Others include missile characteristics such as the ability to vary engine thrust, center of gravity, stall characteristics, and the like. These factors combine to define a missile performance capability 50 at any moment. Some factors, such as the type and extent of movement of control surfaces to define a maximum turning angle θ, are known for the specific missile type, and can be provided from stored performance data 52 in the memory 30. Other factors, such as available range, can be calculated using the stored data, but also can be based upon measurements by the sensors 38 of onboard performance data 54 such as remaining fuel. The missile performance capability data, whether stored or based upon active measurements, represents performance capabilities of the missile.

Figure 5:
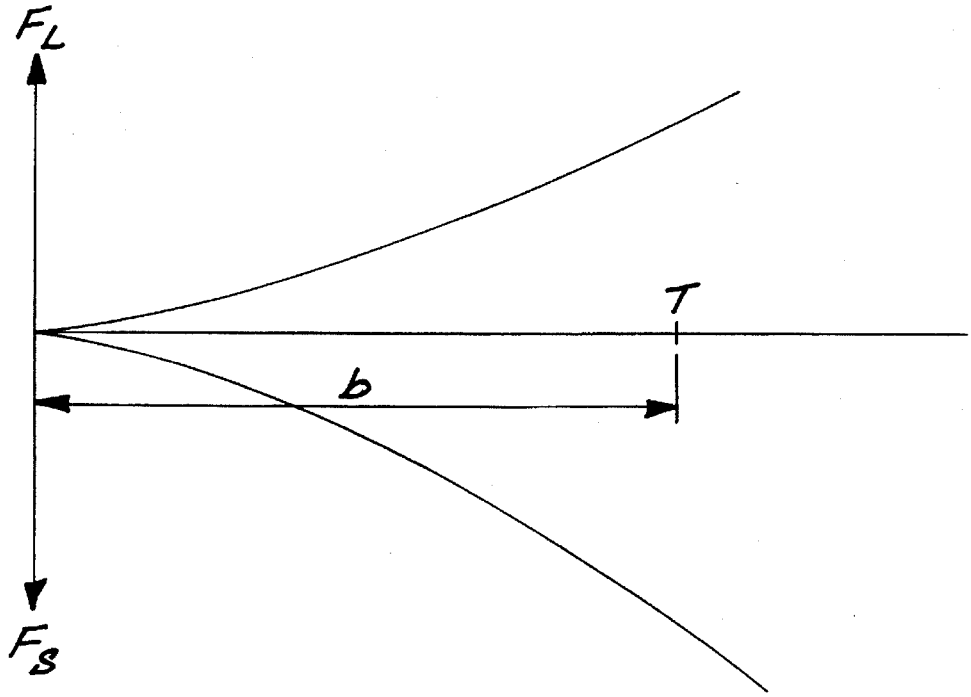
FIG. 5 is a schematic two-dimensional representation of a missile performance envelope.

From the missile performance capability data, a missile performance envelope 56 is established. The missile performance envelope 56 represents the maximum deviation from the aim-point target T that the missile could achieve, and is the more generalized form of the development shown in FIG. 4. As discussed above, FIG. 4 is an oversimplification presented for educational purposes. More realistically, if the missile is pushed to the limit of its ability to deviate from the aim-point target T, the missile follows a diverging curve of the type shown in FIG. 5. Here, the deviation is plotted upwardly for a flight longer ($F_L$) than that to the target T, and downwardly for a flight shorter ($F_S$) than that to the target T. The $F_L$ and $F_S$ curves are not symmetric, as the missile typically has more flight options if the flight is to be terminated early on a nearer target than if it is to be extended to reach a further target. If the flight of the missile is not limited by its fuel and range, the range of options is greatly increased.

The development of the missile performance envelope 56 from the missile performance capacity 50 is based on prior studies of the behavior of the missile, either in flight testing or in simulations. When the missile is designed and tested, an extensive body of knowledge is assembled on the performance of the missile under a wide range of conditions. Included in this knowledge is performance under maximum conditions such as maximum deflection of control surfaces, maximum thrust, and other extreme situations. These are the control conditions that the central controller would command to the missile to reach a target that is maximally separated from the aim-point target, if commanded by the operator using the target indicator 34. Prior to the present invention, such information was available, but was not used in the control process. Thus, the present invention does not include as one of its elements the development of this knowledge, but presumes that it is available from conventional testing and simulation of the missile behavior. Such knowledge is specific to each type of missile. The data used to develop the missile performance envelope 56 is stored in the memory 30 and selectively utilized according to the missile performance capability 50 as needed.

The second factor in determining the prosecutable target locus 58 is the distance 60 of the missile to the aim-point target. The target position 62 is typically known if the target if fixed. If the target is moving, the target position can often be determined by an independent measurement such as the radar 40'. The missile position 64 is determined by the on-board sensor 40 or a separate sensor such as the radar 40'. The distance between the missile and the target is calculated geometrically from this information. Equivalently, the distance 60 may be measured directly, as with a laser or radar range finder in the nose of the missile as discussed previously.

The prosecutable target locus 58 defining the prosecutable target area of the missile 22 is the missile performance envelope 56 evaluated at the distance 60 of the missile to the target. This locus is determined from a look-up table or parametric equations expressing the missile performance envelope 56, or other operable technique, stored in the memory 30.

Figure 6:
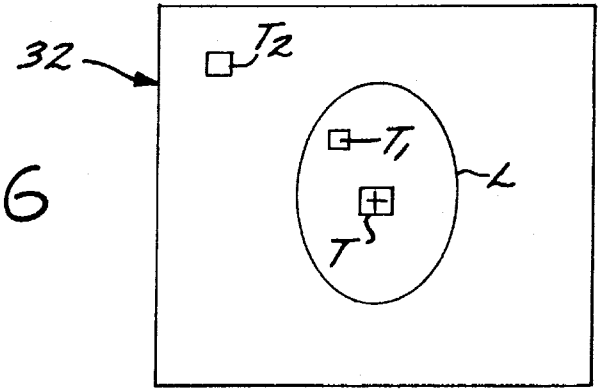
FIG. 6 is a schematic view of a video display of the guidance controller.

FIG. 6 is an example of an image viewed by the operation on the video display 32 at a moment in time. On this display, the cross-hair is the aim-point target T which is, at that moment, the selected target. The prosecutable target locus L, determined in step 58, is presented as an overlay defining the maximum limits of the area within which targets can be prosecuted. That is, any target such as $T_1$ in the area within the L locus can be prosecuted by the missile at the moment depicted on the video display 32. Any target such as $T_2$ outside the locus L is not prosecutable at that moment. The locus L is typically asymmetric, and may be limited by considerations such as range of the missile with the available fuel.

Figure 7:
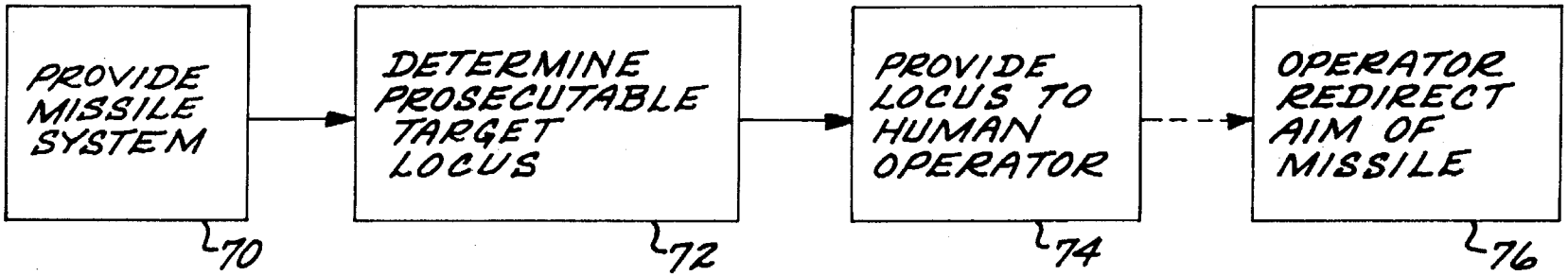
FIG. 7 is a block flow diagram of a method for practicing the invention.

FIG. 7 presents a preferred method for practicing the invention. A missile system such as the system 20 is provided, numeral 70. Any other operable type of vehicle system can be used, as well. The prosecutable target locus is determined, numeral 72, by the approach shown in FIG. 3. This locus and the area within its boundaries is presented to the human operator, numeral 74, preferably on the video display 32. The operator may then optionally redirect the missile to any alternative target (for example, target $T_1$) within the boundaries of the prosecutable target locus, numeral 76. The operator need not make an estimation as to whether the missile is capable of reaching such alterative target, inasmuch as the system provides the display of the target area which can be prosecuted based upon the current status and capability of the missile.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A remotely controlled vehicle system, comprising:

a remote vehicle;

a source of remote vehicle performance capability data;

a source of remote vehicle location data;

a source of remote vehicle imagery;

a base controller including a guidance controller by which a person selectively produces guidance commands for the remote vehicle;

a data link between the base controller and the remote vehicle, the data link including a guidance data channel carrying the guidance commands from the base controller to the remote vehicle; and means for providing to the person a representation of a prosecutable target locus of the remote vehicle within the remote vehicle imagery responsive to the performance capability data and the vehicle location data.

2. The vehicle system of claim 1, wherein the remote vehicle is a missile.

3. The vehicle system of claim 1, wherein the source of remote vehicle performance capability data includes a memory file located in the base controller.

4. The vehicle system of claim 1, wherein the source of remote vehicle performance capability data includes a vehicle status sensor located in the remote vehicle, and wherein the data link includes a vehicle status sensor data channel from the remote vehicle to the base controller.

5. The vehicle system of claim 1, wherein the source of remote vehicle location data includes a separate location sensor separately from the remote vehicle and means for providing data from the separate location sensor to the base controller.

6. The vehicle system of claim 5, wherein the separate location sensor is a radar unit.

7. The vehicle system of claim 1, wherein the source of remote vehicle location data includes an on-board location sensor on the remote vehicle, and wherein the data link includes an on-board location sensor data channel from the remote vehicle to the base controller.

8. The vehicle system of claim 7, wherein the on-board location sensor is a global positioning system receiver.

9. The vehicle system of claim 1, wherein the base controller further includes a video display viewable by the person, and wherein the means for providing includes means for displaying the representation of the prosecutable target locus on the video display.

10. The vehicle system of claim 1, wherein the means for providing includes means for determining a result of a maximum change in a guidance command on the directional performance of the remote vehicle responsive to the remote vehicle performance capability data, the remote vehicle location data, and a vehicle aim-point target, and means for presenting the result to the person.

11. The vehicle system of claim 10, where in the means for determining comprises a computer configured to calculate the result.

12. The vehicle system of claim 1, wherein the means for providing further includes means for providing the representation of the prosecutable target locus relative to a vehicle aim-point target.

13. A remotely controlled vehicle system, comprising:

a missile;

a source of missile performance capability data;

a source of missile location data;

a base controller including a guidance controller by which a person selectively produces guidance commands for the missile, wherein the guidance controller includes a video display that produces an image viewable by the person of a missile aim-point target, and a control unit operable by the person to generate guidance commands responsive to the image on the video display;

a data link between the base controller and the missile, the data link including a guidance data channel carrying the guidance commands from the base controller to the missile; and a computer configured to calculate a prosecutable locus result of a maximum change in a guidance command on the directional performance of the missile responsive to the missile performance capability data, the missile location data, and the aim-point target, and to provide a prosecutable locus result to the video display.

14. The vehicle system of claim 13, further including an imaging sensor in the vehicle that has as an output the missile aim-point target, and wherein the data link includes an image data channel carrying the output of the imaging sensor to the base controller.

15. A method for operating a remotely controlled vehicle system, comprising the steps of:

determining a prosecutable target locus of a remote vehicle responsive to remote vehicle performance capability data, remote vehicle location data, and a missile aim-point target; and providing to a human controller the prosecutable target locus relative to the missile aim-point target.

* * * * *